US005193233A

United States Patent [19]

Miller

[11] Patent Number: 5,193,233

[45] Date of Patent: Mar. 16, 1993

[54] PATIENT TRANSFER UNIT

[76] Inventor: Miles S. Miller, 3431 E. Nisbet Rd., Phoenix, Ariz. 85032

[21] Appl. No.: 932,588

[22] Filed: Aug. 20, 1992

[51] Int. Cl.[5] ..... A61G 7/053; A61G 7/08

[52] U.S. Cl. ..... 5/81.1; 193/35 R

[58] Field of Search ..... 5/81.1; 193/35 R; 414/921

[56] References Cited

U.S. PATENT DOCUMENTS

| | | | |
|---|---|---|---|
| 2,192,821 | 3/1940 | Torines | 5/81.1 |
| 3,792,500 | 2/1974 | Swara, Sr. | 5/81.1 |
| 4,297,753 | 11/1981 | Langren | 5/81.1 |
| 4,873,732 | 10/1989 | Perez | 5/81.1 |
| 4,908,890 | 3/1990 | Beckman | 5/81.1 |
| 4,967,427 | 11/1990 | Cherepy | 5/81.1 |
| 4,987,621 | 1/1991 | Brantman | 5/81.1 |
| 5,152,016 | 10/1992 | Becker | 5/81.1 |

*Primary Examiner*—Alexander Grosz

[57] ABSTRACT

A health care device, (FIG. 1) to transfer a paralyzed or incapacitated patient from wheelchair to auto, bed or recliner etc. A flat, thin lightweight, curved, reversible device comprising closely spaced rollers making left or right hand transfers simple and easy. One end plate has a self-leveling slide portion (22) for high side use when two elevations differ (FIG. 2).

4 Claims, 1 Drawing Sheet

PATIENT TRANSFER UNIT

BACKGROUND

1. Field of the Invention

This invention relates to devices for transferring patients between two proximate support surfaces such as bed to wheelchair, wheelchair to auto or lounge chair etc.

2. Description of Related Art

My past experiences include working with disabled persons including a quadriplegic sister. Many products I used are either very expensive or inefficient. I saw a need for a transfer device that would be simple, less expensive and more versatile. Before searching the prior art, I built and tested my invention and was surprised to see how well it performed. My invention surpassed my expectations being easy and versatile in use, lightweight, and with low final assembly cost.

My patent search revealed various devices and methods for patient transfer. Disclosed in U.S. Pat. No. 4,967,427 and U.S. Pat. No. 4,297,753 are devices with endless belts, both basically square and straight. Their use may be limited in some situations such as a tight space or an odd angle. U.S. Pat. No. 4,987,621 shows a device that has a track with a rolling seat which would require lifting or loading patient onto the seat. Very seldom will a transfer occur side by side or end to end. A standard wheelchair must be placed at an angle to allow for frame, wheel and leg interference. This angle creates a big problem when using a straight or square device by not allowing two opposing corners to lay flat on their rest surfaces. Most present devices require several complex set-up procedures and lack ample surface area for support on a chair creating a safety factor. My invention has a larger chair support surface.

SUMMARY OF THE INVENTION

It is a principal object of the present invention to simplify, yet offer greater flexibility while transferring a patient in a confined area. A device reasonably priced, having no obstructions, completely reversible, and capable of left or right hand moves. Another object is to present a curved combination Slide 'N' Roll unit to offset the angle of the wheelchair, and with one hinged end plate that is self-leveling when used between two different elevations. Another object is to present a device with low friction rollers having axles pretreated with PTFE lubricant thereby greatly reducing friction and easing physical effort by the care-giver. My curved invention creates a natural rotation of the patient which allows a comfortable, final and precise posture. The invention is no more than ¾ thick, has a very smooth surface and very light, weighing under four pounds. Further objects and advantages will become apparent from a consideration of the drawings and ensuing description.

REFERENCE NUMERALS IN DRAWINGS

10-complete view of invention
12-long side support
14-short side support
16-rollers
18-axles
20-fixed end plate
22-end plate-self adjusting
24-hinge
26-fasteners
28-upholstery stabilizers
30-hand carry area

DESCRIPTION OF THE PREFERRED EMBODIMENTS

Figure 1:
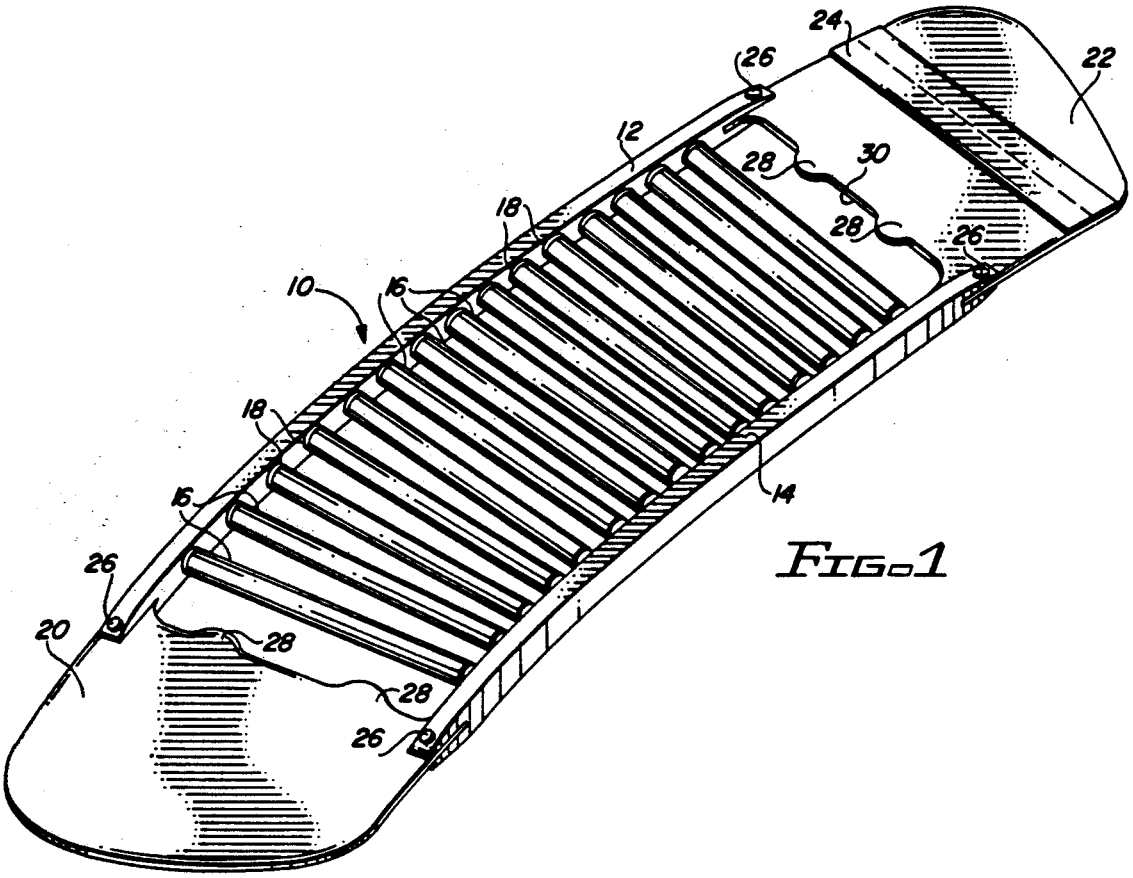
FIG. 1 is a top or bottom perspective view of a preferred embodiment of the invention.

FIG. 1 shows a patient transfer unit 10 with an overall bend of approximately 16 degrees. It is constructed of non-ferrous material with an overall length of 33 inches and a width of 10 inches. This ideal size will fit the needs of an average size patient, but may be lengthened, shortened, or made wider to maximize an individual need. The side support 12 is 2½ inches longer than the side support 14 adding an advantage that causes the end plates 20 and 22 to meet the points of rest in a square and flat approach. The side support 12 ends are slotted, tapered and welded to end plates 20 and 22. The shorter side support 14 is slotted, tapered and attached to end plates 20 and 22 with 3/16" or ¼" fasteners 26 having flush heads. Side support 14 is removable for roller replacement if necessary. The completed frame 12-14-20-22 comprises a ⅓ sliding and ⅔ rolling area. The closely spaced parallel rollers 16 are contained within the frame allowing top and bottom of unit to be identical. The axles, 18 may be made of acrylics, acrylic alloy, aluminum, polycarbonate or other impact resistant material. The axles 18 are pressed into ¾" seamless tubing FIG. 4. The ¾" rollers 16 having axles 18 with a small 7/32 shaft or similar comparable ratio, treated with PTFE lubricant, and fit within burnished apertures, contained in side supports 12 and 14. The end plates, 20 and 22 comprise approximately ⅓ of surface area. End plates 20 and 22 have an additional 10 to 12 degree slope to shorter side support 14 and the material thickness is 3/16" to ¼". End plate 22 is divided in ½ and is fit with a hinge shown in FIG. 3. The hinge 24 may be made of a nylon or polycarbonate strip laying flush along both sides of end plate 22. End plates 20 and 22 have built in upholstery stabilizer 28, a hand carry area 30, through which upholstery may project, has been provided between upholstery stabilizers 28 on both end plates 20 and 22.

Operation—FIGS. 1,2,3,4

Figure 2:
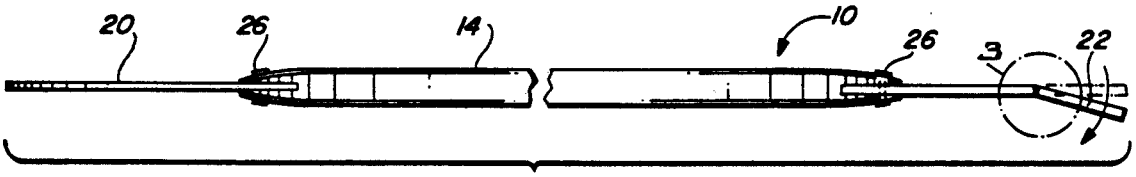
FIG. 2 is a side elevation view of said invention comprising a flexible hinged end plate.

This transfer unit shown in FIG. 2, has side supports 12 and 14 that are ¾ inch thick or less. The end plates, 20 and 22 are 3/16" to ¼" and tapered to a narrow but safe leading edge.

The end plates 20 and 22 are ample size providing a safe, surface area at points of rest, well onto a wheelchair seat or bed. The end plate 22, has a hinge 24, and allows the self-leveling slide ramp portion to be placed usually under the patient. The end plate 22, is best utilized on the high end when a transfer is between two different elevations. This arrangement would be especially helpful when transferring a patient to a car seat.

Figure 3:
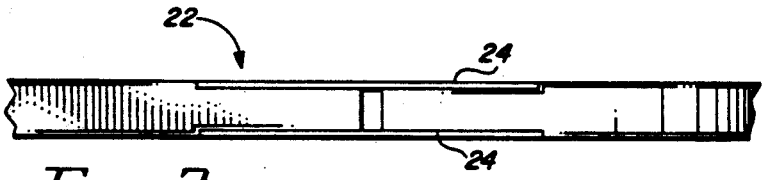
FIG. 3 is a detailed edge view of the nylon or polycarbonate hinge.
Figure 4:
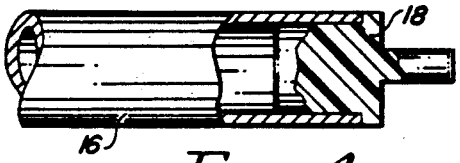
FIG. 4 shows detail of plastic axle.

The hinge 24, FIG. 3, utilizing a polycarbonate or nylon plastic material, covers a slight gap, allowing a stabilized movement. This ramp action is further utilized by the weight of the patient and becomes self leveling.

The fasteners 26, have smooth tapered heads that lay flat to the surface of removable side support 14.

The axles 18, about 1 inch long, are pressed into both ends of rollers 16, making a tight seal. The ¾ inch rollers 16, utilizing small diameter axles 18, FIG. 4, treated with a PTFE lubricant, offer little resistance while transferring a patient.

The upholstery stabilizers 28, with abrupt point areas defined by upholstery engaging tabs, hold the chair fabric that is forced up through opening 30 when the patients weight is on the unit.

Conclusion, Ramifications, and Scope

My patient Slide 'N' Roll transfer unit is light-weight, thin, smooth, and with no obstructions. This allows versatility when using top or bottom for left or right hand moves. Simplicity is incorporated into the design to make the unit economical. It is easy to clean and sterilize.

While my above description contains many specificities, these should not be construed as limitations on the scope of the invention, but rather as an exemplification of one preferred embodiment thereof.

Many other variations are possible for example, the invention can be anodized. The roller diameter could be larger or smaller. The frame could be stamped out as one piece with a separate roller assembly attached. Axle diameters can vary. The degree of curve could be changed.

Accordingly, the scope of the invention should be determined not by the embodiment illustrated, but by the appended claims and their legal equivalents.

I claim:

1. A curved, reversible patient transfer unit comprising:

(a) a central area defined by two curved elongated, and generally parallel side support members with a plurality of closely spaced, elongated rolling members positioned between said side support members, said central area being bounded by said side support members and two end portions; and (b) two end areas, defined by a first end plate attached to one end portion of the central area, and a second end plate attached to the other end portion of the central area, with at least one of the end plates comprising a hinge portion adapted to permit the pivoting of a portion of one of said end plates relative to an adjacent portion of said end plate.

2. A curved, reversible patient transfer unit comprising:

(a) a central area defined by two curved elongated, and generally parallel side support members with a plurality of closely spaced, elongated rolling members positioned between said side support members, said central area being bounded by said side support members and two end portions; and (b) two end areas, defined by a first end plate attached to one end portion of the central area, and a second end plate attached to the other end portion of the central area, with at least one of the end plates comprising an upholstery stabilizer (28) including an opening (30) through which seat upholstery material can protrude when said patient transfer unit has one end placed on an upholstered seat and a patient is being transferred to said seat, and upholstery engaging tabs (28) projecting into said opening (30), said opening further serving as a convenient hand hold for carrying said unit (10).

3. The unit of claims 1 or 2, wherein the unit is approximately ¾ inches thick or less.

4. The unit of claims 1 or 2 wherein the unit weighs under four pounds.

* * * * *